US010914528B2

(12) United States Patent
Wunning

(10) Patent No.: US 10,914,528 B2
(45) Date of Patent: Feb. 9, 2021

(54) HIGH-TEMPERATURE HEAT EXCHANGER

(71) Applicant: WS-WARMEPROZESSTECHNIK GMBH, Renningen (DE)

(72) Inventor: Joachim A. Wunning, Leonberg (DE)

(73) Assignee: WS-WARMEPROZESSTECHNIK GMBH, Renningen (DE)

( * ) Notice: Subject to any disclaimer, the term of this patent is extended or adjusted under 35 U.S.C. 154(b) by 928 days.

(21) Appl. No.: 14/351,958

(22) PCT Filed: Oct. 8, 2012

(86) PCT No.: PCT/EP2012/069873
§ 371 (c)(1),
(2) Date: Apr. 15, 2014

(87) PCT Pub. No.: WO2013/057003
PCT Pub. Date: Apr. 25, 2013

(65) Prior Publication Data

US 2014/0262174 A1 Sep. 18, 2014

(30) Foreign Application Priority Data

Oct. 19, 2011 (EP) ..... 11185815

(51) Int. Cl.
*F28D 7/16* (2006.01)
*F28F 1/00* (2006.01)
(Continued)

(52) U.S. Cl.
CPC ..... *F28D 7/1615* (2013.01); *F28D 7/16* (2013.01); *F28D 7/1661* (2013.01);
(Continued)

(58) Field of Classification Search
CPC ..... F28D 7/16; F28D 9/0243; F28D 7/1661; F28D 7/1676; F28D 7/1692;
(Continued)

(56) References Cited

U.S. PATENT DOCUMENTS 1,946,234 A 5/1931 Price
3,420,297 A * 1/1969 Romanos ..... F28D 7/06 122/510
(Continued)

FOREIGN PATENT DOCUMENTS

EP 1876391 A1 * 1/2008 ..... F22G 1/005
EP 1995516 A1 * 11/2008 ..... F23D 14/66
(Continued)

OTHER PUBLICATIONS

R. Shankar Subramanian, Heat Transfer in Flow Through Conduits, 2008, Clarkson University Dept of Chemical and Biomolecular Engineering.*
(Continued)

*Primary Examiner* — Elizabeth J Martin
*Assistant Examiner* — Nael N Babaa
(74) *Attorney, Agent, or Firm* — Ronald S. Lombard

(57) ABSTRACT

This flat tube heat exchanger encompasses a closed housing, in which two tube sheets and a tube bundle, which is arranged between the tube sheets and which is supported by the tube sheets is arranged. The tube bundle comprises at least some flat tubes, which extend in longitudinal direction of the tube bundle. At their ends, the flat tubes are round and are flat in a central section. The ends of the flat tubes, which have a round cross section, can be circular or can encompass a different round shape.

9 Claims, 5 Drawing Sheets

Figure 2:
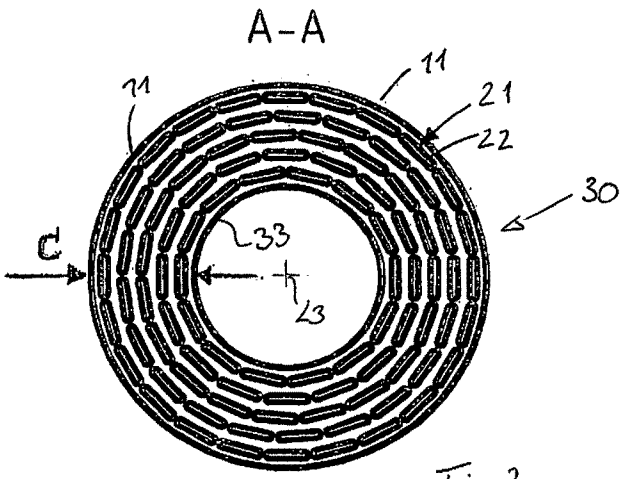

(51) Int. Cl.
*F28F 13/08* (2006.01)
*F28F 9/02* (2006.01)
*F28F 9/22* (2006.01)

(52) U.S. Cl.
CPC ..... *F28D 7/1676* (2013.01); *F28D 7/1692* (2013.01); *F28F 1/006* (2013.01); *F28F 9/0243* (2013.01); *F28F 13/08* (2013.01); *F28F 2009/224* (2013.01); *F28F 2009/226* (2013.01); *F28F 2265/26* (2013.01)

(58) Field of Classification Search
CPC ... F28D 7/1067; F28F 13/08; F28F 2009/224; F28F 2009/226; F28F 1/006; F28F 9/0243
See application file for complete search history.

(56) References Cited

U.S. PATENT DOCUMENTS 4,785,879 A * 11/1988 Longsworth ..... F25B 9/02 165/147
4,836,276 A 6/1989 Yamanaka et al.
5,101,892 A * 4/1992 Takeuchi ..... F28F 9/182 165/158
5,704,423 A 1/1998 Letrange
6,000,467 A * 12/1999 Tokizaki ..... F28D 1/05391 165/110
6,161,615 A * 12/2000 Brieden ..... F28D 9/005 165/166
7,243,707 B2 7/2007 Brost
7,921,559 B2 4/2011 Zobel
8,091,620 B2 1/2012 Gorbounov et al.
8,261,816 B2 9/2012 Ambros
8,281,489 B2 10/2012 Zobel
8,622,736 B2 1/2014 Wunning et al.
8,683,690 B2 4/2014 Zobel
8,726,508 B2 5/2014 Zobel
2003/0075309 A1* 4/2003 Langl ..... F28D 7/0066 165/159
2010/0132927 A1* 6/2010 Benetton ..... F25B 39/02 165/158

FOREIGN PATENT DOCUMENTS

EP 2138795 A1 12/2009
FR 2293684 2/1976
FR 2812719 8/2002
JP 58054321 12/1983
JP Sho 63-015001 1/1988
JP 2005-180268 7/2005
JP 2005180268 A 7/2005
JP 2011-033229 2/2011
KR 10-2010-0018509 2/2010
WO WO1996020808 7/1996
WO WO 2010083978 A2 * 7/2010 ..... B01J 9/006

OTHER PUBLICATIONS

Notice of Preliminary Rejection from the Korean Patent Office dated Aug. 8, 2018 regarding a corresponding application No. 10-2014-7010063 (6 pages).
English Translation of said Korean Patent Office Notice of Preliminary Rejection for Korean application No. 10-2014-7010063 (5 pages).

* cited by examiner

HIGH-TEMPERATURE HEAT EXCHANGER

CROSS REFERENCE TO RELATED APPLICATION

The present application is based upon and claims the benefit of PCT/EP2012/069873, filed 8 Oct. 2012; which is based on European patent application no. 11 185 815.5, filed 19 Oct. 2011.

BACKGROUND OF THE INVENTION

The invention relates to a high-temperature heat exchanger, in particular for gaseous media.

The energy efficiency of high-temperature processes can be increased considerably with the help of gas/gas heat exchangers, if the heat exchangers transfer the heat content of a gas flow to another gas flow as completely as possible. The gas flows can be reactants and products, for example, of a chemical reaction process, for example in the form of a combustion process. The reaction can take place in a SOFC combustion cell or a fuel cell system, for example, in micro gas turbines or other thermal engines. In many cases, the mass or heat capacity flows, respectively, of the two gases (e.g. fresh air and exhaust gas) are thereby approximately the same.

Corresponding heat exchangers must satisfy different requirements, which can only be combined with difficulty to some extent. The heat exchangers must be suitable for:

- high temperatures and therein in particular for
- a large temperature differences, that is, a large difference between the inlet temperatures of the two media. In the case of SOFC systems, this temperature difference can be up to 800 K.
- High efficiencies of the heat transfer of more than 80%, if possible are thereby pursued as well as
- a compact design,
- low pressure drops,
- low production costs and
- high durability.
- Pressure differences between the two gas flows must also be withstood. Further requirements, such as, for example,
- high resistance to temperature changes can play a role in the case of systems, which are frequently turned on and off or started up and shut down, respectively.

SUMMARY OF THE INVENTION

Various heat exchanger arrangements are known for bringing media in heat exchange with one another. For example, WO 96/20808 discloses a heat exchanger comprising a closed, approximately cylindrical vessel, which is closed by means of rounded end caps and tube sheets, which are arranged at opposite ends of the vessel. The tube sheets divide the interior into three separate spaces, namely, e.g., two collecting spaces and a tube bundle space therebetween. The connections of the collecting spaces are arranged, e.g., so as to be concentric to the longitudinal axis of the cylindrical housing at the end caps thereof. Inflow and outflow of the tube bundle space are arranged radially, e.g. at the cylindrical housing wall. Depending on the embodiment, the tubes of the tube bundle are embodied so as to be straight, e.g., and are provided with sections of a different cross section. Circular cross sections alternate with oval cross sections.

While the above-mentioned document discloses a closed heat exchanger, EP 1 995 516 B1 shows an open heat exchanger comprising flat tubes, which are only encased on one side. At their ends, the tubes are round and are embodied so as to be flat in a central section. In the flat section, the cross section of the tube is formed by two sections, which delimit a gap and which are curved with a large radius, wherein they are connected to one another at their ends by means of sections, which are curved with a large radius. The flat tubes are arranged on concentric circles of the heat exchanger, which, as whole, is embodied so as to be substantially rotationally symmetrical. The same number of tubes is thereby provided on each circle. Corrugated spacers are arranged between the tubes. This flat tube heat exchanger is operated in countercurrent flow. Nozzles, which effect a high gas outlet speed, are arranged at the side of the flat tubes facing a combustion chamber. Specifically, this is an exhaust gas heat recuperator, which is to effect a flameless oxidation in the connected combustion chamber due to the high gas outlet speed.

It is the task of the invention to specify a heat exchanger, which fulfills the above-mentioned conditions. In particular, it is to combine a large temperature difference, a high transfer efficiency, a high packaging density and a long service life with low pressure drops and low production costs.

This task is solved by means of the flat tube heat exchanger according to claim 1:

The flat tube heat exchanger according to the invention encompasses a closed housing, in which two tube sheets and a tube bundle, which is arranged between the tube sheets and which is supported by the tube sheets is arranged. The tube bundle comprises at least some flat tubes, which extend in longitudinal direction of the tube bundle. At their ends, the flat tubes are round and are flat in a central section. The ends of the flat tubes, which have a round cross section, can be circular or can encompass a different round shape. E.g., they can encompass an elliptical cross section, an oval cross section or also a polygonal cross section (triangular, square, rectangular, hexagonal or the like), which becomes similar to a round shape. The cross section of the round section is preferably between 50% and 70% of the cross section of the flat cross section. While the round cross sections are circular, the flat cross sections have an oval shape, which preferably consists of curved end sections comprising a small radius and straight wall sections without a curvature. For example, such flat tubes are produced in starting with a tube, which encompasses a section comprising a circular cross section and a larger diameter between two sections comprising a circular cross section and a smaller diameter. The section comprising the larger diameter can be flattened, e.g. between cylinder rollers, in a reshaping process, e.g. a rolling process. The configuration of the flat tubes described in this respect is preferred for all embodiments of the heat exchanger according to the invention.

Preferably, three zones are embodied in the tube bundle space, namely two transverse flow zones, which are embodied at the tube bundle space connections, and one longitudinal flow zone, which is embodied between said transverse flow zones. The transverse flow zones are preferably defined in that provision is in each case made on both sides, which adjoin the tube sheets, for a section, in that the flat tubes encompass a round cross section (preferably circular cross section) or a polygonal cross section similar to a circle and are tapered, so as to provide for the inflow or outflow, respectively, of the gas transversely to the flat tubes. Preferably, corresponding channels are embodied between the individual flat tubes for this purpose. It is preferred to orient these channels in inflow or outflow direction, respectively. In the case of a rotationally symmetrical design, these channels are preferably oriented in radial direction. The inflow or outflow can flow radial from the inside or also radial from the outside or to the outside. The transverse flow direction, which is defined by the transverse flow zone, is preferably oriented vertically to the flat sides of the flat tubes, that is, parallel to the surface normal direction of the flat sides. This concept can also be applied in the case of all of the embodiments of the heat exchanger.

The longitudinal flow zone is defined in that substantially no transverse flow exists in it. The flow, which occurs between the flat tube sections, runs anti-parallel to the flow, which flows in the flat tubes. In particular, the flow preferably does not change between the different longitudinal flow ducts, which are present between the flat tubes. This is achieved in that adjacent flat tubes are arranged so as to touch one another or so as to almost touch one another with a slight gap.

The flat tube heat exchanger can be designed as a rectangle or also as a round arrangement. In the rectangular arrangement, it encompasses a cube-shaped tube bundle space. In the round arrangement, it encompasses a cylindrical tube bundle space. Preferably, the heat exchanger is designed in round arrangement as ring heat exchanger. Its housing is then delimited cylindrically or also polygonally, e.g.. Coaxially to the outer wall, the heat exchanger housing can encompass an inner wall. The latter can surround further aggregates, such as, e.g., a reactor, in which the supplied process gas runs through a chemical process, a burner, another heat source of combinations thereof. In the case of a preferred embodiment, the longitudinal flow space, in which the flat sections of the flat tubes are arranged, is embodied in a ring-shaped manner (that is, hollow cylindrically). In contrast, at least one of the two transverse flow spaces is preferably embodied in a cylindrical manner and encompasses a free central gas distribution space (gas collecting space), from which the gas flow leads radial to the outside between the round sections of the flat tubes (or vice versa).

In transverse flow direction, the tube bundle preferably encompasses an expansion, which is maximally twice as large as the length of the transverse inflow zone, which is measured in longitudinal tube bundle direction. A uniform distribution of the gas can be achieved through this before it flows through the longitudinal flow zone between the flat tubes. The mentioned measure also creates a good prerequisite for being able to arrange the flat tubes in the tube bundle in a relatively tight manner, thus resulting in a good utilization of space and thus in a compact design. Adhering to certain dimensions for the flat tubes can also contribute to this. Preferably, the flat tubes have an inner gap width s of between 1 mm and 5 mm, preferably between 1 mm and 3 mm. Optimally, the gap width is 2 mm. The free width of the flat tube interior is preferably between 7 mm and 20 mm. The flat tubes are preferably arranged in a packing density p of between 0.9 $m^2/dm^3$ and 0.2 $m^2/dm^3$.

Space-maintaining structures, e.g. in the shape of imprinted burls, ribs or the like, can also be present at the flat tubes, so as to fix the distance between the tubes. The maximum distance between the flat tubes is preferably in the size of the gap width. The gap width is preferably a few millimeters at best. The distance of the rounded areas of the flat tubes from one another is preferably smaller than the gap width. The channels, which are formed between the flat tubes, are thus virtually separated from one another. The uniform gas distribution in the transverse flow zone is of considerable importance.

Instead of flat tubes, so-called structured tubes can also be used, in the case of which the heat transfer is improved by means of turbulence vortices. To generate turbulence vortices, turbulence-generating elements, e.g. ribs, protrusions, dents or the like, can be embodied at the inner and/or outer surfaces of the flat tubes.

Preferably, all of the flat tubes have the same shape, are thus embodied uniformly, which keeps the production effort low.

The tubes can be embodied in one piece or in several pieces. This can be advantageous in particular in the case of a very large temperature difference. Tubes made of different materials can be joined to one another bluntly, in particular by means of welding. In the cold zone, different materials can thus be used than in the warm zone. An expansion element, which compensates the expansion differences between the housing and the tube bundle, can be arranged at the housing. The expansion compensation element is preferably arranged at the cold side of the heat exchanger.

In the event that the heat exchanger tubes are arranged in one ring zone, which surrounds a central area, a burner comprising a combustion chamber can be arranged at that location, e.g. so as to heat a reactor, which is present at that location. An insulating layer is preferably arranged between the combustion chamber and the heat exchanger. This combination of heat exchanger and combustion chamber is suitable, for example, for heating the cathode air for a SOFC fuel cell.

A catalytic reactor can also be attached in the interior, in particular in the tube bundle space of the heat exchanger. Said catalytic reactor can be arranged, e.g. as reformer, in the anode gas cycle of a SOFC fuel cell system.

Efficiencies above 80% can be achieved by means of the flat tube exchanger according to the invention. Preferably, the gas, which is to be heated, is guided in the tubes, and the gas, which releases heat, is guided between the tubes. Gases comprising very high inlet temperatures, such as 1000° C., e.g., can be processed. Based on the construction volume, the heat transfer rates are within the same range as the heat transfer rates of plate heat exchangers and regenerators, which have comparable gap widths. However, welded plate heat exchangers are not suitable for such high temperatures. The proposed flat tube heat exchangers is thus suitable in particular in the case of the local energy production, e.g. in the case of SOFC fuel cells or micro gas turbines. The switchover valves and control systems, which are required in the case of regenerators, are not necessary.

Other objects and advantages of the present invention will become apparent to those skilled in the art upon a review of the following detailed description of the preferred embodiments and the accompanying drawings.

IN THE DRAWINGS

Figure 3:
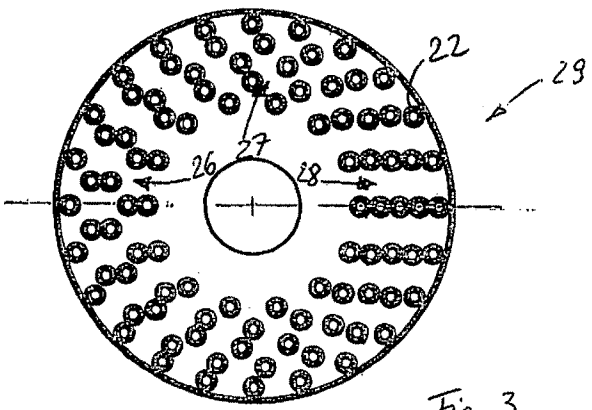
Figure 1:
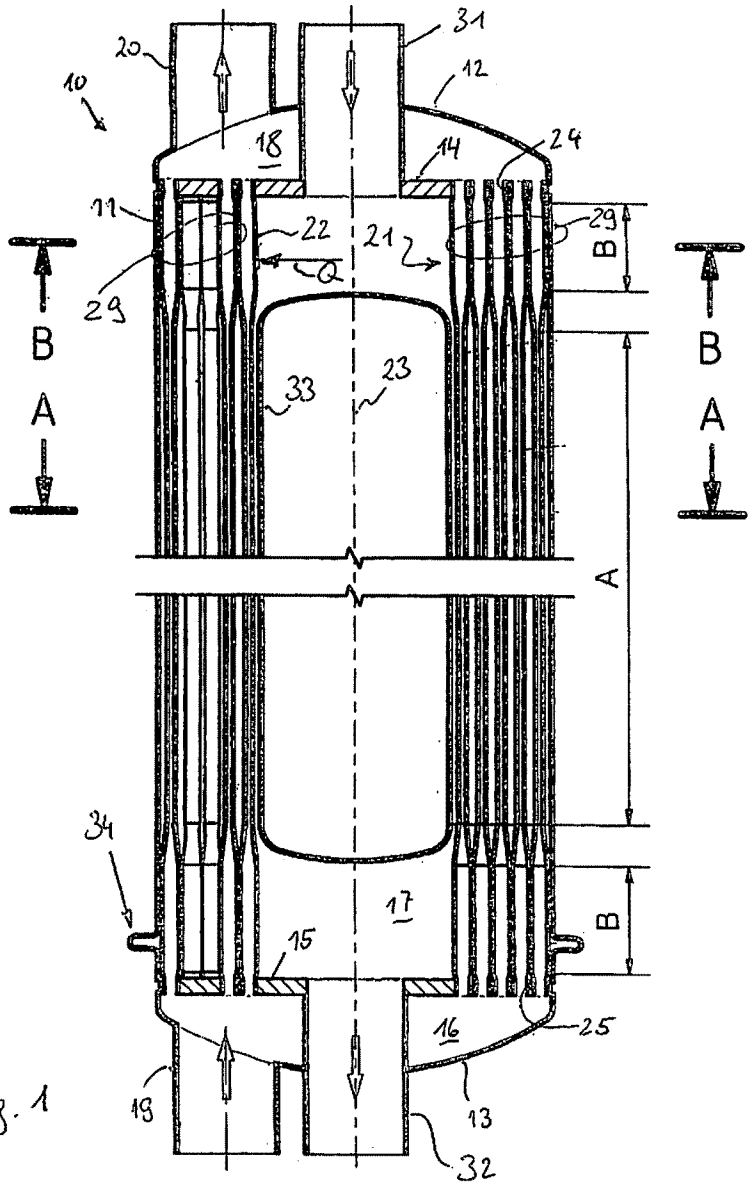
Figure 4:
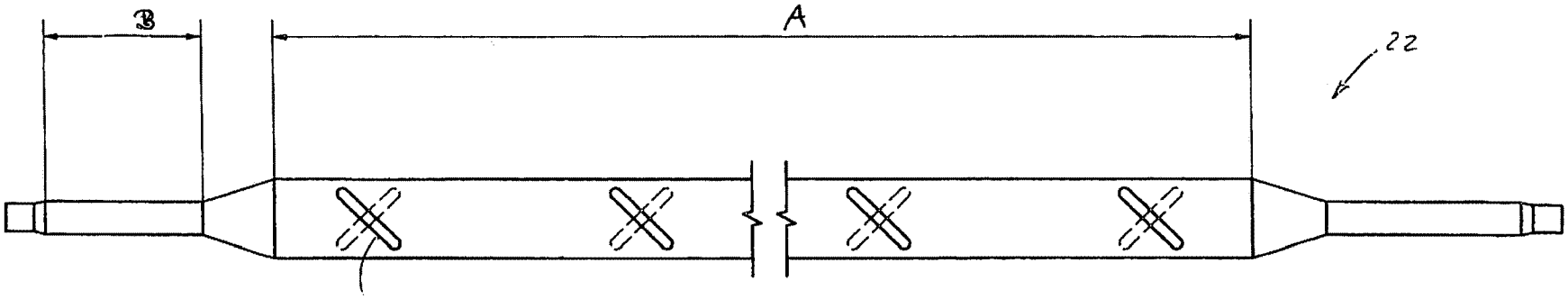
Figure 5:
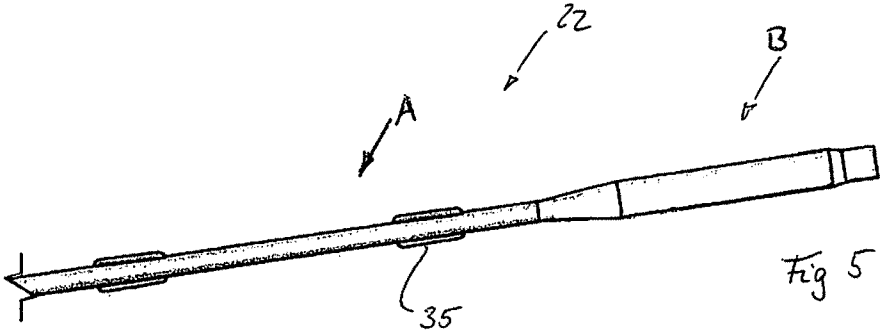
Figure 6:
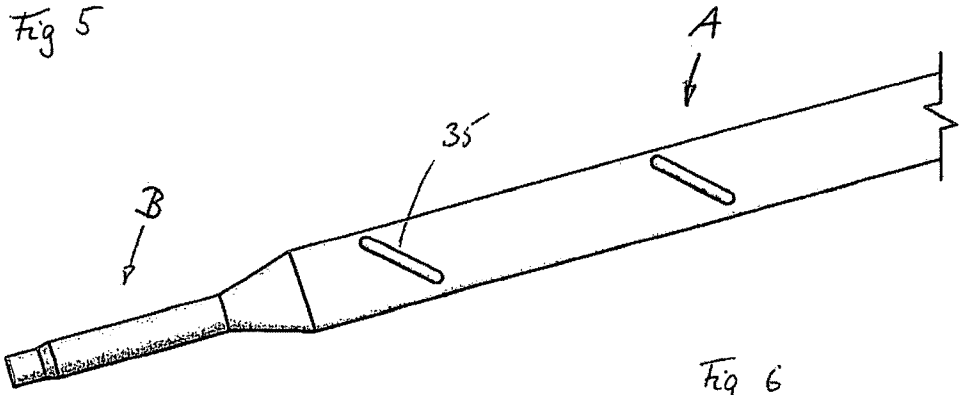
Figure 7:
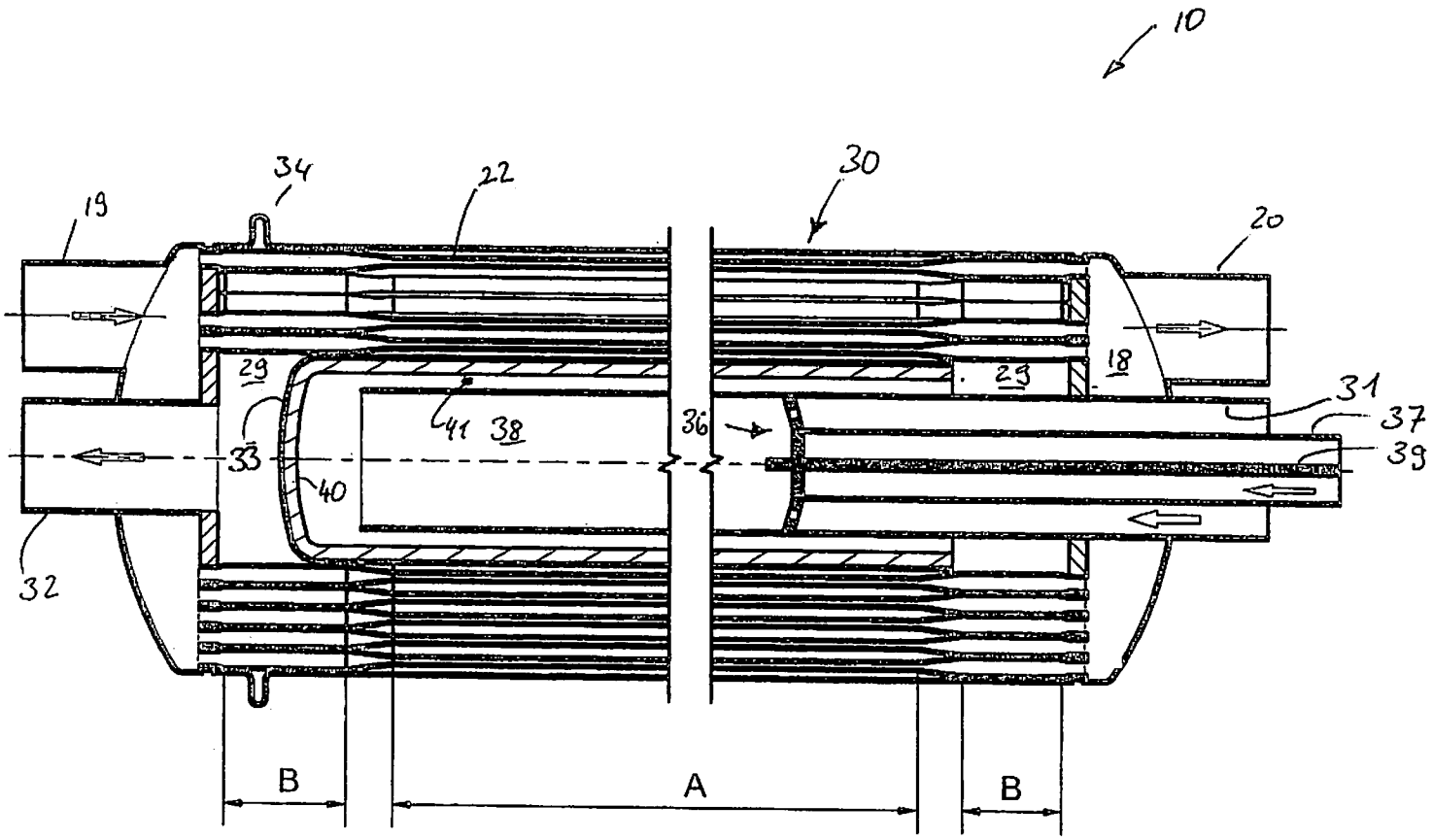
Figure 8:
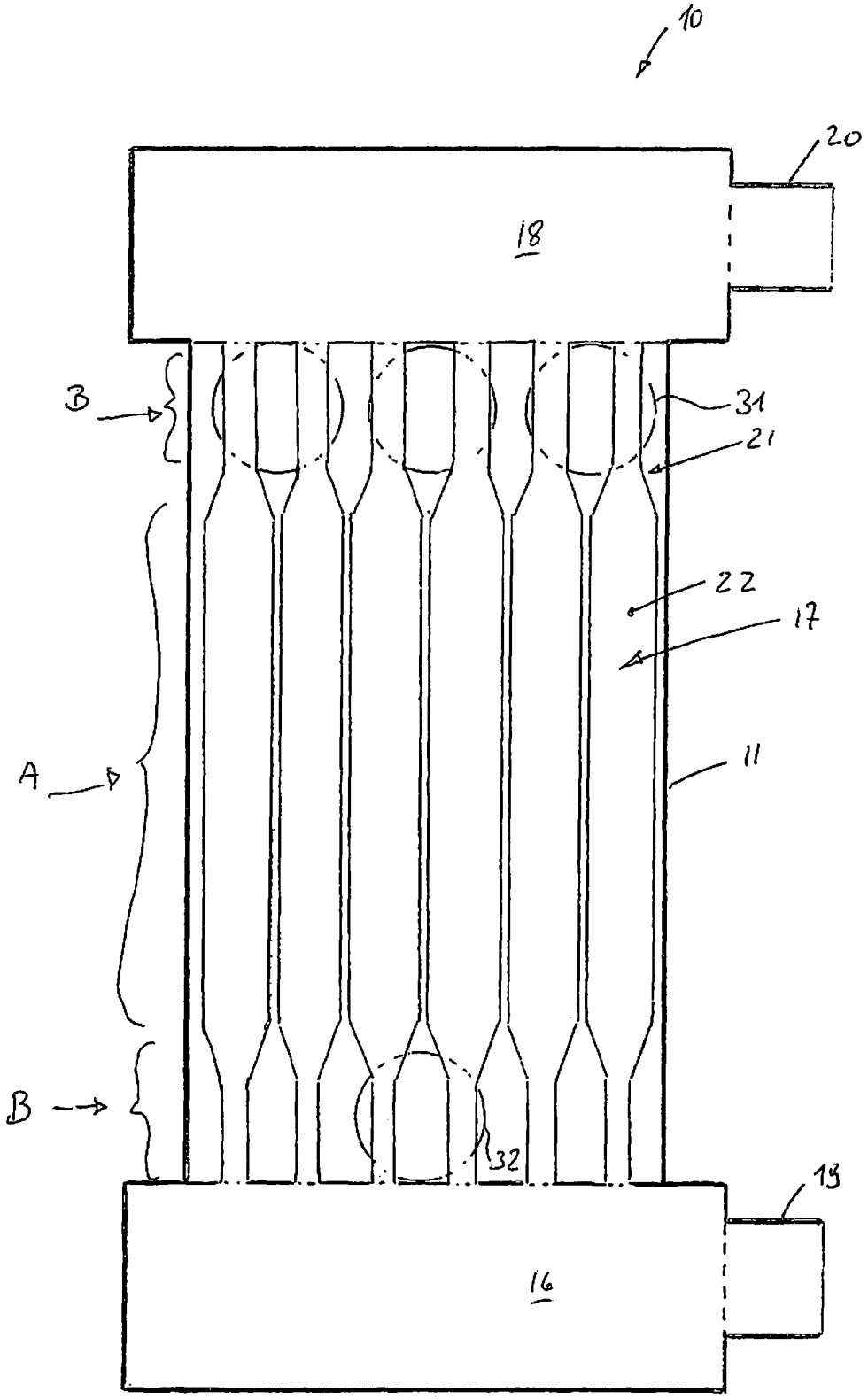
Figure 10:
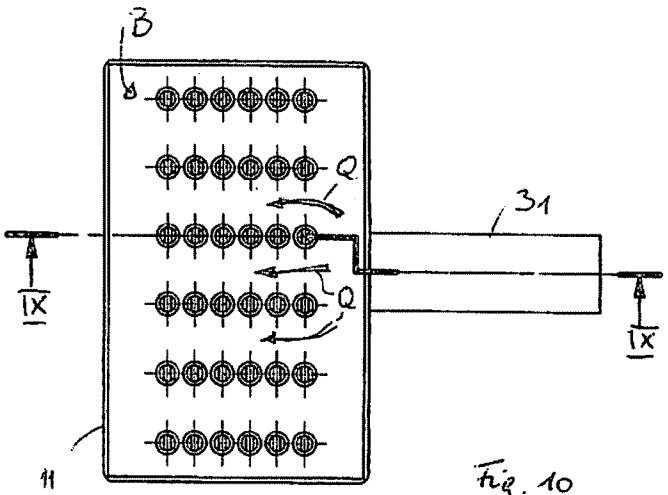
Figure 11:
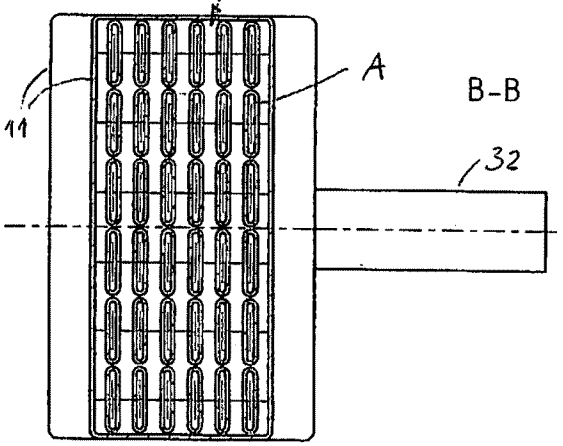
Figure 9:
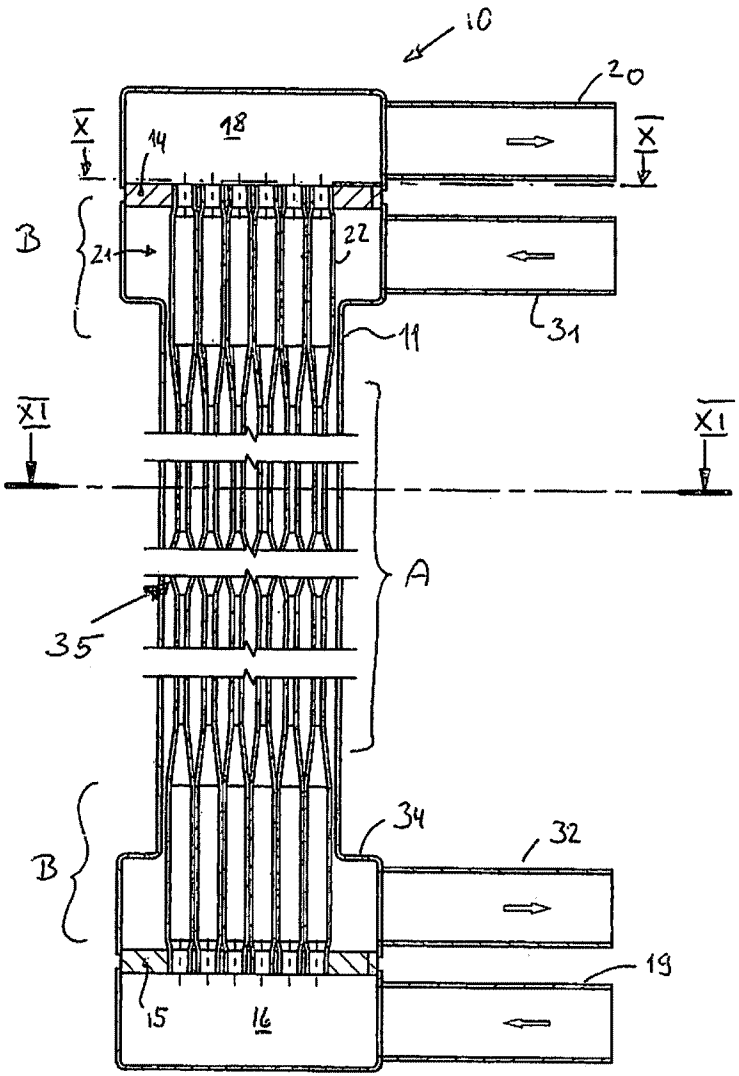

FIG. 1 shows a flat tube heat exchanger according to the invention in a diagrammed longitudinal section, FIG. 2 shows the flat tube heat exchanger according to FIG. 1, cut along line A-A in FIG. 1, FIG. 3 shows the flat tube heat exchanger according to FIG. 1, cut along line B-B in FIG. 1, FIG. 4 shows a flat tube of the flat tube heat exchanger, in top view, in diagrammed illustration, FIG. 5 shows the flat tube according to FIG. 4, in a sectional side view, FIG. 6 shows the flat tube according to FIGS. 4 and 5, in a perspective view, FIG. 7 shows the flat tube heat exchanger comprising a mounted burner, in a longitudinally cut schematic diagram, FIG. 8 shows a modified embodiment of the flat tube heat exchanger according to the invention, in vertical section, FIG. 9 shows a further modified embodiment of the flat tube heat exchanger according to the invention, in vertically cut side view, FIG. 10 shows the flat tube heat exchanger according to FIG. 9, cut along line X-X in FIG. 9 and with a cutting line IX-IX for illustrating the formation of the cut in FIG. 9, and FIG. 11 shows the flat tube heat exchanger according to FIG. 9, cut along line XI-XI in FIG. 9.

DETAILED DESCRIPTION OF THE INVENTION

FIG. 1 illustrates a flat tube heat exchanger 10, which is accommodated here in a cylindrical housing 11. Preferably, curved cover lids 12, 13, which belong to the housing 11 and which can be a part thereof, e.g., are attached at both ends of the housing 11. The housing 11, together with the lids 12, 13, encloses an inner space, which is divided into a total of three spaces, namely a collecting space 16 (FIG. 1, bottom) at the inlet side, a tube bundle space 17 and a collecting space 18 at the outlet side, by means of two tube sheets 14, 15. The collecting spaces 16, 18 are in each case provided with a connection 19, 20. Cold air, e.g., is applied to the connection 19. Hot air, e.g., is to be emitted at the connection 20.

A tube bundle 21 is arranged between the tube sheets 14, 15. Said tube bundle 21 consists of numerous flat tubes 22, which are preferably embodied equally among one another. The transverse sections of the flat tubes 22 encompass straight shoulders, which delimit the inner gap cross section between one another. The flat shoulders are connected to one another by means of sections, which are curved with a slight radius. Each flat tube 22 is preferably embodied so as to be straight and is arranged parallel to an imaginary central axis 23 of the housing 11. With their ends, 24, 25, the flat tubes 22 are anchored to the tube sheets 14, 15. For example, they are welded, hard-soldered, pressed, crimped or connected in a different suitable manner to the respective tube sheet 14, 15. Preferably, the connection is fluid-tight and temperature-resistant.

Each flat tube 22 encompasses a comparatively long central section A comprising a flat cross section and a shorter section B comprising a round section at its two ends 24, 25. FIG. 2 illustrates the tube bundle 21 in the area of its section A in sectional illustration. As can be seen, each flat tube 22 encompasses an inner gap cross section, the width of which is between 1 mm and 4 mm, preferably between 2 mm and 3 mm. The circumference of this cross section preferably lies between 20 mm and 40 mm. As can be seen, the flat tubes 22 are in each case arranged in a row, which is closed in a ring-shaped manner, wherein each row is circular (strictly speaking polygonal) and is arranged concentric to the central axis 23.

Within the row, the flat tubes 22 are at least preferably arranged such that the individual flat tubes 22 do not touch one another with their sections, which are heavily curved. However, the remaining gaps between the flat tubes 22 within a row are small. In the alternative, the flat tubes can also touch one another at every temperature or only at certain temperatures. The flat sides of the flat tubes are oriented in circumferential direction, thus tangentially to the respective circle, on which they are arranged.

The ring-shaped spaces formed between the rows or boundaries of different flat tubes 22 are relatively narrow. These are ring-shaped flow ducts, which are largely kept free from other components. The individual ring-shaped flow ducts are largely separated from one another by means of the flat tube wreaths.

It is pointed out that other flat tube configurations can be used. For example, the flat tubes can be arranged in a single row, which is wound into a coil. They can also be slightly inclined against the circumferential direction, thus slightly rotated about their respective longitudinal axis. They then draw an acute angle with the tangential direction. However, the above explanations with regard to the cross sectional shape and tube distances apply accordingly.

Preferably, the number of the tubes, which are arranged in every ring-shaped row illustrated in FIG. 2, is calculated such that a row results, which is closed, if possible. Preferably, the number of the flat tubes 22 in the rows does not correspond to one another. The number of tubes preferably increases from the inside to the outside, viewed in radial direction. Preferably, the number of tubes of adjacent ring-shaped rows differs by 1 to 3, preferably 2.

As can be seen from FIG. 3, the flat tubes 22 form an arrangement, which, with its sections B, is radially flow-permeable, at least more permeable than the arrangement of the sections A according to FIG. 2. Flow ducts 26 to 28, which provide for a radial flow, are formed. In the case of the round sections B of the flat tubes 22, a transverse flow zone 29 is thus formed. This applies to the ends 24 of the flat tubes, which adjoin the upper tube sheet 14, as well as to the ends 25 of the flat tubes 22, which adjoin the lower tube sheet 15. In transverse inflow direction, the tube bundle 21 encompasses a thickness C, which is preferably maximally twice as large as the length of section B, that is, of the transverse inflow zone. The flat sections A of the flat tubes 22 can extend into the transverse inflow zone 29, in particular in the event that the transverse inflow, as is also possible, takes place parallel or at an acute angle to the flat sides of the flat sections. This applies to all of the embodiments.

The sections A of the flat tubes 22, which are located between the two transverse flow zones 29, form a longitudinal flow zone 30, which serves for the actual heat exchange.

Tube bundle space connections 31, 32, which can be arranged coaxially to the central axis 23, e.g., and which, in this case, permeate cover lids 12, 13 and the tube sheets 14, 15, serve to introduce and divert fluid in the tube bundle space 17. It is pointed out that the tube bundle connections 31, 32 can also be arranged elsewhere. For example, they can be embodied so as to be attached radially or tangentially to housing 11 in the areas B while permeating the housing 11. In addition, an inner housing wall 33 can be arranged concentric to the central axis 23. Said housing wall 33 can be arranged concentric to the central axis 23. Said housing wall 33 can be formed by means of a solid body or a hollow body. It can surround further system parts, a heat storage vessel or the like, or also can be empty.

At a suitable location, the housing 11 can be provided with an expansion element 34. Preferably, the latter is attached in the cylindrical area of the housing 11 between the tube sheets 14, 15, preferably in the vicinity of the colder tube sheet, that is, of the connection 19 at the inlet side. The expansion compensation element 34 is shown in FIG. 1 as a protrusion in the housing 11 which can allow an axial expansion and compression of the housing 11 within certain limits, so that the distance between the tube sheets 14, 15 is defined by the temperature and thus by the length of the tube bundle 21. The housing 11 adapts accordingly.

The flat tube heat exchanger 10, which has been described in this respect, works as follows:

During operation, hot, preferably gaseous fluid, for example exhaust gas of a micro gas turbine or the like, is supplied to the flat tube heat exchanger 10 via the tube bundle space connection 31. Above the approximately cylindrical central body, which is surrounded by the inner housing wall 33, this flow is deflected substantially in radial direction. It reaches the channels 26 to 28, which can be seen in FIG. 3, and is distributed radially and in circumferential direction in the tube bundle 21. Starting at the transverse inflow zone 29, the hot gas flow then runs in longitudinal direction substantially parallel to the central axis 23 through the ring-shaped zones between the flat tubes 22, which can be seen in FIG. 2. The heat contained in the hot gas flow is transferred to the wall of the flat tubes 22.

At the same time, cold gas, e.g. air comprising ambient temperature, is guided via the connection 19 at the inlet side into the colleting space 16. From there, it enters into the round lower ends of the flat tubes 22 and flows through the inner gap volumes of the flat tubes 22 into the colleting space 18 located on the opposite side. It thereby flows in countercurrent flow to the hot gas, the inlet temperature of which can be approximately 1000°, e.g.. The supplied cool air absorbs a large portion of the heat and can reach 800° or 900°, e.g., in the collecting space. It then discharges via the connection 20 at the outlet side.

Due to the illustrated flow structure, the flat tube heat exchanger 10 has only a slight differential pressure demand for the hot gas flow as well as for the cold gas flow. The resulting pressure loss is low. Due to the narrow gap width of the flat tubes 22 and of the tight arrangement thereof, a high heat utilization is reached. The exhaust gas, which leaves the tube bundle space 17 via the tube bundle space connection 32, is cooled down, e.g. to low temperatures of a few 100° C., e.g., 200° C. or 300° C.

FIGS. 4 to 6 illustrate optional details of the flat tube 22. In the sections A and B, it preferably encompasses different circumferences, as has already been explained above by means of the cross sections.

As a further option, in particular the flat sides of section A of each flat tube 22 can be provided with protrusions 35, e.g. in the form of burls or ribs, fins or the like. These protrusions 35 can serve as spacers, so as to prevent that flat tubes 22 from different rows come too close to one another and block the flow duct, which is present therebetween. It is also possible to use these protrusions 35 as turbulence-generating elements, so as to improve the heat transfer of the hot gases, which flow between the flat tubes 22, to the flat tubes 22.

FIG. 7 illustrates a modified embodiment of the flat tube heat exchanger 10. The latter is combined structurally herein with a burner 36 so as to generate hot gas. For this purpose, the tube bundle space connection 31 is embodied or used, respectively, as air supply duct for combustion air. In this duct, a fuel duct 37 is arranged concentrically, e.g.. Via the latter, residual anode gas or another fuel, e.g. can be guided into the combustion chamber 38. The combustion chamber 38 can be arranged in the interior of the container, which is surrounded by the inner housing wall 33. A starter electrode 39, which can extend through the fuel duct 37, e.g., completes the burner. On the inside, the inner housing wall 33 can be provided with a thermally insulating lining 40. Together with a tube, which delimits the combustion chamber 38, it forms a ring channel 41, which is open towards the transverse flow space 29. From there, the hot gas, which is emitted by the burner 36, flows through the longitudinal flow zone 30 (tube sections A), so as to emit the heat, which is present at that location. The cooled-down exhaust gas leaves the flat tube heat exchanger 10 again through the transverse flow zone 29 (on the left-hand side in FIG. 7) and the tube bundle space connection 32. The air, which is supplied via the connection 19, is guided in countercurrent flow through the flat tubes 22 and is thereby heated to high temperatures, so as to be emitted through the collecting space 18 and the connection 20 at a high temperature, or considerably higher than 700° or 800°. In this arrangement, the flat tube heat exchanger 10 forms a heat exchanger comprising an internal heat source. A burner serves as heat source. Otherwise having the same embodiment, other heat sources can also be integrated into the heat exchanger 10.

The above-described principles can also be realized at non-ring-shaped or non-cylindrical heat exchangers, respectively. FIG. 8 illustrates such a flat tube heat exchanger 10. The tube bundle 21, which is formed by the flat tubes 22, is surrounded by a housing 11 comprising a rectangular or square cross section. The flat tubes 22 are arranged in rows, which are parallel to one another, and which are embodied as described above. Their round sections B form transverse flow zones. For example, hot gas can be supplied to the tube bundle space 17 via one or a plurality of connections 31. Cooled-down hot gas can be discharged from the tube bundle space 17 via one or a plurality of connections 32. The collecting spaces 16, 18 can be embodied in a box-shaped manner. In the case of this embodied and in the case of the above-described embodiments, the tube bundle, which is formed by the flat tubes 22, encompasses a thickness in transverse flow direction, which is preferably maximally twice as large as the length of section B, that is, of the transverse inflow zone. This serves to reach a uniform gas distribution between the flat tubes 22. While the direction of the transverse inflow in the case of the embodiment of the flat tube heat exchanger 10 according to FIG. 8 is determined by the longitudinal direction of the connections 31, 32, (in FIG. 8 vertically to the drawing plane), this direction is the radial direction in the case of the above embodiments. The thickness C of the tube bundle 21 in the exemplary embodiment according to FIGS. 1 to 3 is thus determined by the distance of the outer wall of the housing 11 with the inner housing wall 33. This distance C is preferably maximally 1.5 to 2 times as large as the length B.

A further modified heat exchanger 10 is illustrated in FIG. 9 to FIG. 11. Insofar as there is structural and/or functional correspondence with the heat exchanger 10 according to FIG. 8 and, in the broader sense, with the heat exchanger 10 according to FIGS. 1-7, reference is made to the description above by taking the reference numerals, which have already been introduced, as basis. Additionally, reference is made to the protrusions 35, which are embodied herein as thickenings of the flat sections A of the flat tubes 22. The thickenings serve as spacers. The flat tubes 22, which are between 0.5 and 1 m, e.g., can encompass such thickenings 35 at a distance of several dm, e.g. 2 dm. They stabilize the distances between the flat tubes 22 and make the heat exchanger 10 insensitive against thermal deformation, e.g. due to temperature differences.

To improve the energy efficiency of high-temperature processes, a flat tube heat exchanger 10 is proposed, which is suitable for high temperatures, tolerates a large temperature difference, and achieves transfer efficiencies above 80% in countercurrent-flow operation. In addition, it encompasses a high packing density, low pressure drops, for example less than 50 mbar, high durability and robustness, and low production costs. The flat tube heat exchanger encompasses flat tubes, which encompass flat tube heat exchanger sections and round ends. The round ends define transverse inflow zones, which produce a uniform gas distribution of a hot gas among the flat sections of the flat tubes 22 with low pressure drops. The efficiency of such a flat tube heat exchanger is comparable to the efficiency of a plate heat exchanger, wherein, however, such a flat tube heat exchanger is substantially more robust.

LIST OF REFERENCE NUMERALS

10 flat tube heat exchanger
11 housing
12, 13 cover lids
14, 15 tube sheets
16 collecting space at the inlet side
17 tube bundle space
18 collecting space at the outlet side
19 connection at the inlet side
20 connection at the outlet side
21 tube bundle
22 flat tube
23 central axis
A flat section of the flat tube 22
B round section of the flat tube 22
C tube bundle thickness
24, 25 end of the flat tube 22
26-28 channels
29 transverse flow zone
30 longitudinal flow zone
31, 32 tube bundle space connections
33 inner housing wall
34 expansion compensation element
35 protrusions
36 burner
37 fuel duct
38 combustion chamber
39 starter electrode
40 lining
41 ring channel
Q transverse flow direction The above detailed description of the present invention is given for explanatory purposes. It will be apparent to those skilled in the art that numerous changes and modifications can be made without departing from the scope of the invention. Accordingly, the whole of the foregoing description is to be construed in an illustrative and not a limitative sense, the scope of the invention being defined solely by the appended claims.

I claim:

1. A flat tube heat exchanger (10) configured to transfer heat from one gas flow to another gas flow, comprising:

a closed cylindrical housing (11, 12, 13) which encloses an inner space, which, at two sides, which are located opposite one another within the inner space, encompasses a first tube sheet (14) and a second tube sheet (15), which divide the inner space into a collecting space (16) at an inlet side in the closed cylindrical housing (11, 12, 13), a tube bundle space (17) between the first tube sheet (14) and the second tube sheet (15) in the closed cylindrical housing (11, 12, 13) and a collecting space (18) at an outlet side in the closed cylindrical housing (11, 12, 13), the closed cylindrical housing (11, 12, 13) having a central axis (23), a tube bundle (21), the tube bundle (21) which defines a tube bundle longitudinal direction which is coaxial with the central axis (23) and which consists of flat heat exchanger tubes (22), which are embodied so as to be straight, each straight flat heat exchanger tube (22) comprising a round or polygonal cross-section section (B) at opposite ends (24, 25) of the flat heat exchanger tubes (22), and a central section (A) positioned between the round or polygonal cross-section sections (B), the central section (A) having a flat cross-section, the straight flat tubes (22) are arranged in rows parallel to the longitudinal tube bundle direction coaxial with the central axis (23), and the round or polygonal cross-section sections (B) at the opposite ends (24, 25) of the straight flat tubes (22) are fastened respectively to the first tube sheet (14) and the second tube sheet (15), the first tube sheet (14) and the second tube sheet (15) having corresponding openings therein configured to fluidly connect the round or polygonal cross-section sections (B) to the collecting spaces (16, 18), so that the straight flat tubes (22) are operatively arranged between the first tube sheet (14) and the second tube sheet (15) in fluid communication with the collecting spaces (16, 18), the straight flat tubes (22) in operative arrangement in the tube bundle space (17), each of the collecting spaces (16, 18) is provided with at least one collecting space connection (19, 20) and the tube bundle space (17) is provided with at least two tube bundle space connections (31, 32), which are arranged at a distance from one another in the longitudinal tube bundle direction coaxial with the central axis (23) and which are arranged to permeate the first and second tube sheets (14, 15) and also the collecting spaces (16, 18), one of the tube bundle space connections (31) being configured to introduce a stream of fluid into the tube bundle space (17) between the tubes (22), an inner housing wall (33) operatively arranged within the tube bundle space (17) between the first tube sheet (14) and the second sheet (15) and concentric to the central axis (23) and configured as a cylindrical central solid body or a hollow body and configured to redirect the introduced stream of fluid that is guided through the first tube sheet (14) into the tube bundle space (17) through the tube bundle space connection (31) in a radial direction after entering the tube bundle space (17) so that the introduced stream of fluid is deflected to be distributed radially and circumferentially in the tube bundle space (17) outside of the tubes (22) between and transverse to the rows of tubes (22) at the round or polygonal cross-section sections (B) of the flat tubes (22), the tube bundle space (17) encompassing three flow zones between the tubes (22), the three flow zones being defined by the arrangement of the tubes (22) and the outer shape of the tubes (22), including two transverse flow zones (29) embodied at the tube bundle space connections (31, 32) and one longitudinal flow zone (30) being defined by the arrangement of the central sections (A) of each tube (22) having a flat cross-section, the transverse flow zones (29) adjoining directly at the first and second tube sheets (14, 15), the transverse flow zones (29) being defined by the arrangement of the round or polygonal cross-section sections (B) of each tube (22) proximate the first and second tube sheets (14, 15), the one longitudinal flow zone (30) is located between said two transverse flow zones (29), wherein each flat tube (22) in the central section (A) defines a gap within the flat tube (22), wherein the central sections (A) are arranged such that a distance between the adjacent flat tubes (22) in a row of flat tubes (22) is at most as large as the width of the gap within the flat tube (22) or wherein the central sections (A) of the adjacent flat tubes (22) are arranged in a row of flat tubes (22) that touch each other to prevent the flow from changing between rows of the flat tubes (22) in the longitudinal flow zone (30), the closed cylindrical housing (11, 12, 13) encompasses the inner wall (33), a cross section of which is closed in a ring-shaped manner, and an outer wall (11), a cross section of which is also closed in a ring-shaped manner, each of the rows of flat tubes (22) are closed in a ring-shaped manner concentric to the central axis (23) of the housing (11, 12, 13) in a form of a wreath, in the central sections (A) a plurality of ring-shaped flow ducts extending the length of the central sections (A) are configured between the concentric wreaths of flat tubes (22), wherein the round or polygonal cross-section sections (B) in the transverse flow zones (29) form an arrangement which is, transverse to the tube bundle longitudinal direction (23), and is configured to be more flow permeable than the arrangement of the central sections (A) with the flat cross-section, wherein the tube bundle (21) comprises a countercurrent flow heat exchanger in the longitudinal flow zone (30) having the ring-shaped flow ducts between the concentric wreaths of flat tubes (22) in the central sections (A) configured to prevent transverse flow in the longitudinal flow zone (30) and configured to permit countercurrent flow.

2. The flat tube heat exchanger according to claim 1, characterized in that, if the tube bundle (21) encompasses a transverse expansion (C) in the transverse zones (29) in transverse flow direction (Q) and if the transverse flow zones (29) encompasses a length (B) in longitudinal tube bundle direction (23), the length (B) is at least 0.5-times the transverse expansion (C).

3. The flat tube heat exchanger according to claim 1, characterized in that the inner wall (33) surrounds a heat source (36).

4. The flat tube heat exchanger according to claim 1, characterized in that transverse flow ducts (26, 27, 28) are embodied between the round ends of the flat tubes (22).

5. The flat tube heat exchanger according to claim 1, characterized in that the tube bundle space connections (31, 32) are arranged so as to permeate the tube sheet (14, 15).

6. The flat tube heat exchanger according to claim 1, characterized in that the flat tubes (22) are provided with spacer structures (35).

7. The flat tube heat exchanger according to claim 1, characterized in that at least some of the flat tubes (22) are provided with turbulence-generating structures (35).

8. The flat tube heat exchanger according to claim 1, characterized in that the housing (11) includes at least one expansion compensation element (34) attached in the cylindrical area of the housing (11) between the tube sheets (14, 15), the expansion compensation element (34) is configured as a protrusion in the housing (11) to allow an axial expansion and compression of the housing (11).

9. The flat tube heat exchanger according to claim 1, characterized in that a catalyst is arranged in the tube bundle space (17).

* * * * *